US009257773B2

(12) United States Patent
Kitajima et al.

(10) Patent No.: US 9,257,773 B2
(45) Date of Patent: Feb. 9, 2016

(54) CONNECTOR

(71) Applicant: Sumitomo Wiring Systems, Ltd., Yokkaichi (JP)

(72) Inventors: Mitsunori Kitajima, Yokkaichi (JP); Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/324,795

(22) Filed: Jul. 7, 2014

(65) Prior Publication Data

US 2015/0031250 A1 Jan. 29, 2015

(30) Foreign Application Priority Data

Jul. 26, 2013 (JP) ..... 2013-155980

(51) Int. Cl.
*H01R 13/436* (2006.01)

(52) U.S. Cl.
CPC ..... *H01R 13/4362* (2013.01)

(58) Field of Classification Search
USPC ..... 439/595, 752, 733.1
See application file for complete search history.

(56) References Cited

U.S. PATENT DOCUMENTS

| | | | | |
|---|---|---|---|---|
| 6,589,083 | B2 * | 7/2003 | Kobayashi et al. | 439/752 |
| 6,592,411 | B2 * | 7/2003 | Mase et al. | 439/752 |
| 6,835,097 | B2 * | 12/2004 | Nankou et al. | 439/595 |
| 6,951,484 | B2 * | 10/2005 | Tsuji | 439/595 |
| 7,014,505 | B1 * | 3/2006 | Tanaka et al. | 439/595 |
| 7,114,992 | B2 * | 10/2006 | Sagawa et al. | 439/595 |

FOREIGN PATENT DOCUMENTS

JP 2005-123078 5/2005

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A female connector (F) includes a retainer (30) to be housed into a mounting hole (14) and selectively mounted, in a housing (10), at a partial locking position for allowing insertion of terminal fittings (50) and a full locking position for locking already inserted terminal fittings (50). A base (33) is at a rear end of the retainer (30) in a mounting direction into the housing (10) and is located outside a mounting hole (14) when the retainer (30) is at the partial locking position. Backlash eliminating portions (21, 22, 41, 42) are formed on the base (33) and in the housing (10) and are configured to restrict a relative displacement of the retainer (30) with respect to the housing (10) when the retainer (30) is at the partial locking position.

2 Claims, 12 Drawing Sheets

CONNECTOR

BACKGROUND OF THE INVENTION

1. Field of the Invention

The invention relates to a connector.

2. Description of the Related Art

Japanese Unexamined Patent Publication No. 2005-123078 discloses a connector with a housing and a terminal fitting that is insertable into the housing. The housing is formed with a mounting hole and a retainer can be mounted into the mounting hole in a direction intersecting an inserting direction of the terminal fitting. The retainer can be held at a partial locking position for allowing the terminal fitting to be inserted into the housing and a full locking position for locking the inserted terminal fitting. Connection structures are provided on an outer surface of a base end part of the retainer in a mounting direction and an inner surface of the mounting hole of the housing. The connection structures engage one another for restricting relative displacement of the retainer at the full locking position with respect to the housing.

The connection structures disclosed in Japanese Unexamined Patent Publication No. 2005-123078 exhibit a backlash eliminating function when the retainer is at the full locking position, but do not eliminate backlash when the retainer is at the partial locking position. Thus, the retainer may be displaced with respect to the housing and a part of the retainer may enter an insertion path for the terminal fitting in a terminal housing chamber when the retainer is at the partial locking position. In this case, the terminal fitting may interfere with the entering part of the retainer and affect a smooth inserting operation of the terminal fitting.

The invention was completed based on the above situation and aims to restrict a relative displacement of a retainer mounted at a partial locking position with respect to a housing.

SUMMARY OF THE INVENTION

The invention is directed to a connector a housing in which a mounting hole is formed to be open. At least one terminal fitting is provided and is configured to be inserted into the housing. The connector also comprises a retainer to be mounted into the mounting hole. The retainer is selectively movable between a partial locking position where the retainer allows insertion of the terminal fitting and a full locking position where the retainer locks the already inserted terminal fitting to retain the terminal fitting. The retainer has a base at a rear end of the retainer in a mounting direction into the housing. The base is located outside the mounting hole when the retainer is at the partial locking position. Backlash eliminating portions are formed on the base of the retainer and in the housing and are configured to restrict relative displacement of the retainer with respect to the housing by contact each other when the retainer is at the partial locking position. The backlash eliminating portions contact each other when the retainer is at the partial locking position and restrict relative displacement of the retainer with respect to the housing. The backlash eliminating portions relative displacement of the retainer will not adversely affect the insertion of the terminal fitting.

A guide rib may be formed on an outer surface of the housing for stabilizing a connecting posture of the connector with a mating connector, and the backlash eliminating portion of the housing may be formed on the guide rib. Thus, the shape of the housing can be simplified as compared with the case where the guide rib does not have the function as the backlash eliminating portion.

A slide-contact portion may be on a tip side of the retainer in the mounting direction and may be substantially parallel to a mounting direction of the retainer. Additionally, the housing may be formed with a guide that is parallel to the mounting direction of the retainer. The guide may contact the slide-contact portion when the retainer is at the partial locking position. The contact of the slide-contact portion and the guide prevents inclination of the retainer.

DETAILED DESCRIPTION OF A PREFERRED EMBODIMENT

Figure 9:
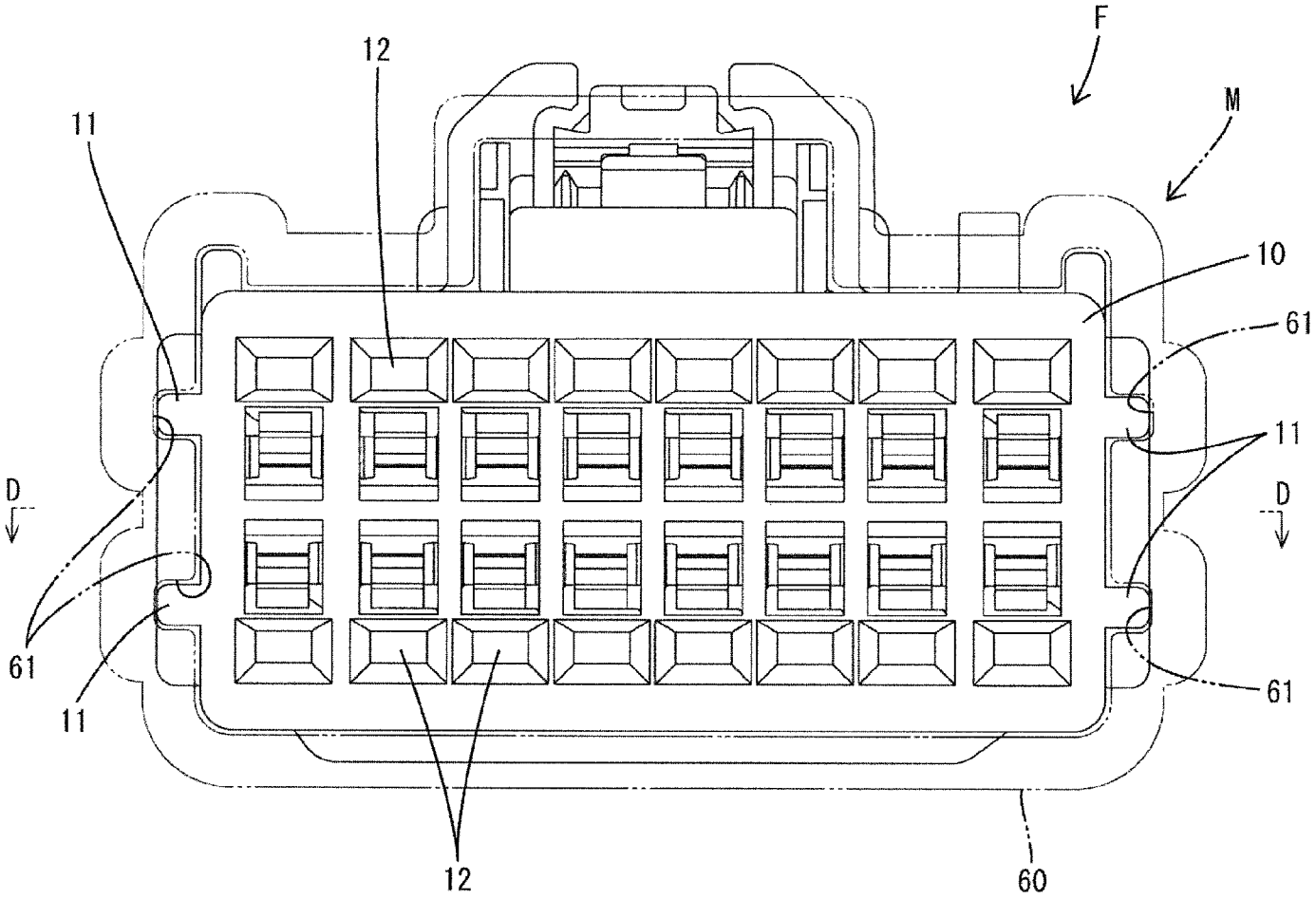
FIG. 9 is a front view of a housing.

A male connector M is shown in FIG. 9 and includes a receptacle 60 to be connected to a female connector F in accordance with the invention. Two vertically spaced guide grooves 61 are formed on the inner surface of each of left and right walls of the receptacle 60 and extend parallel to a connecting direction of the connectors M, F.

The female connector F is formed by assembling a housing 10 made of synthetic resin, a plurality of terminal fittings 50 and a retainer 30 made of synthetic resin. As shown in FIG. 9, two vertically spaced guide ribs 11 are formed on each of opposite left and right surfaces of the housing 10. The guide ribs 11 extend straight in a front-back direction parallel to the connecting direction of the female connector F and the male connector M. The guide ribs 11 fit into the guide grooves 61 in the process of connecting the female connector F and the mating connector M. Thus, the two connectors M, F are connected smoothly in stable postures and without being inclined.

Figure 3:
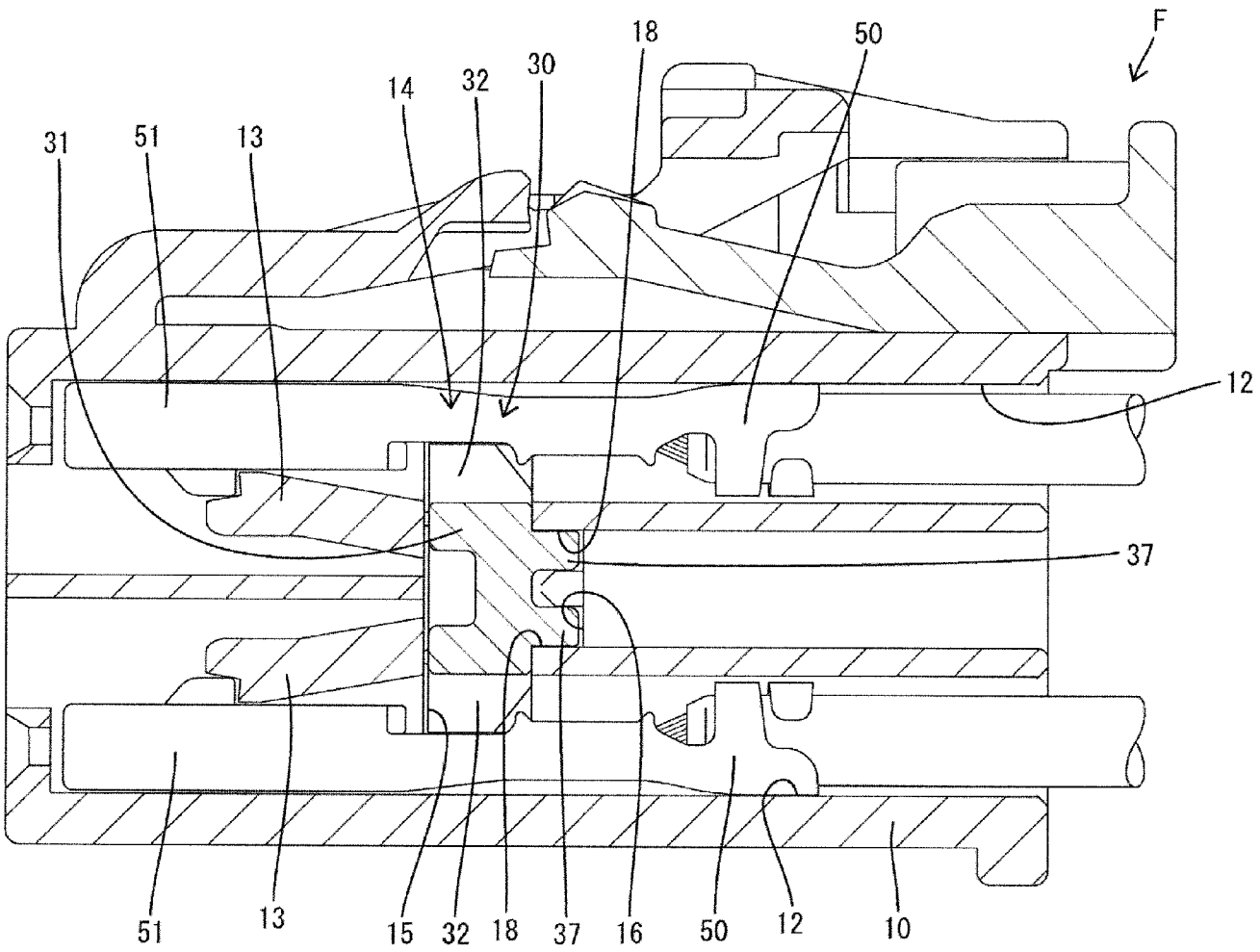
FIG. 3 is a section along B-B of FIG. 1.

Terminal housing chambers 12 are formed in upper and lower rows in the housing 10, as shown in FIG. 3. The terminal fittings 50 are inserted into each terminal housing chamber 12 from behind (right side in FIG. 3) and are retained by the locking action of a locking lance 13. The terminal fitting 50 inserted into the terminal housing chamber 12 also is retained by the locking action of the retainer 30 to be described later.

Figure 1:
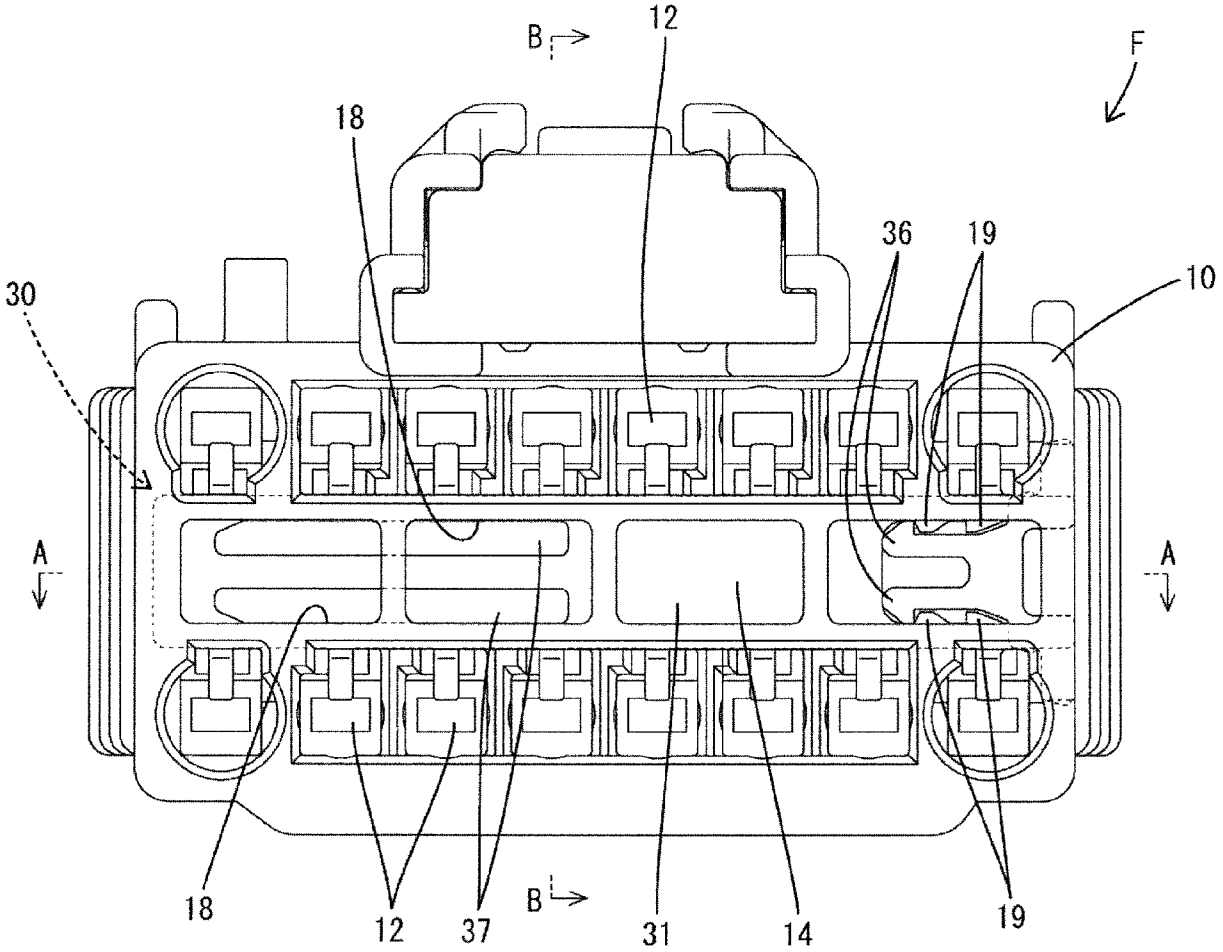
FIG. 1 is a rear view of a connector in accordance with an embodiment of the invention showing a retainer mounted at a full locking position.
Figure 2:
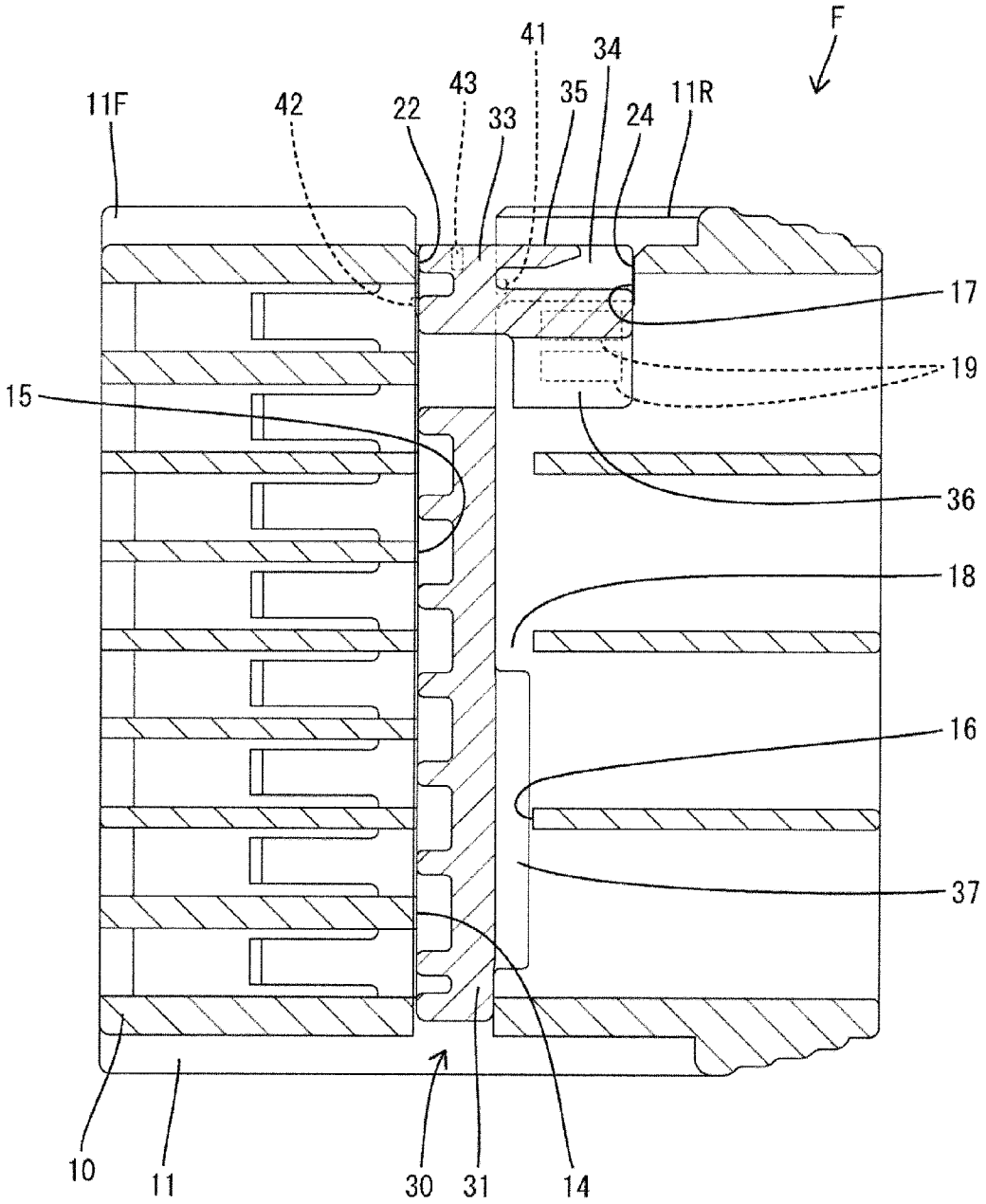
FIG. 2 is a section along A-A of FIG. 1.
Figure 10:
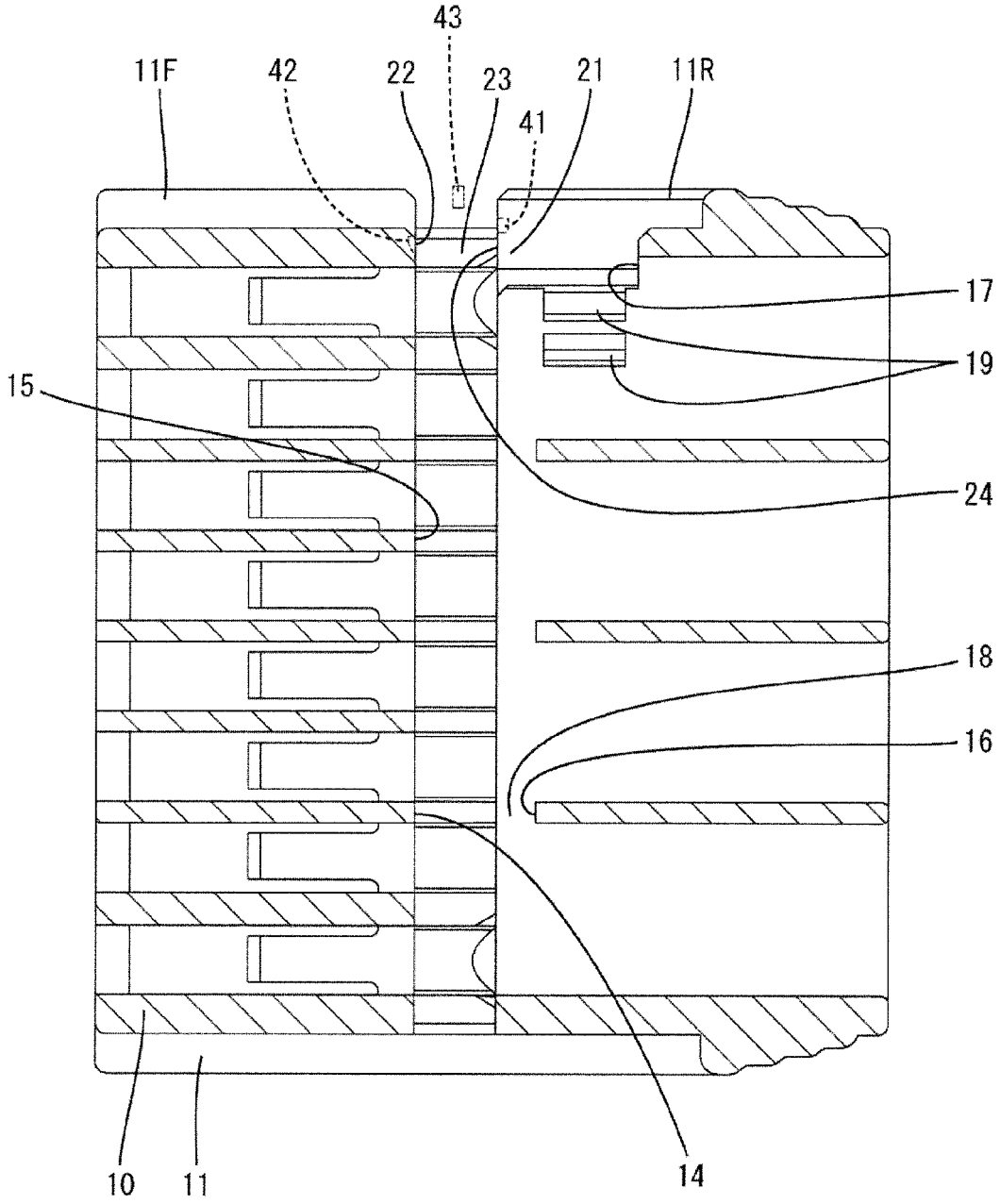
FIG. 10 is a section along D-D of FIG. 9.

As shown in FIG. 10, a mounting hole 14 is formed in the housing 10 and opens on opposite left and right surfaces of the housing 10. An opening area of the mounting hole 14 on the right surface of the housing 10 is larger than that of the mounting hole 14 on the left surface of the housing 10. The retainer 30 is mounted in the mounting hole 14 from the right side of the housing 10 and is held selectively at either of a partial locking position (FIGS. 4 and 5) or a full locking position (FIGS. 1 and 2).

Figure 5:
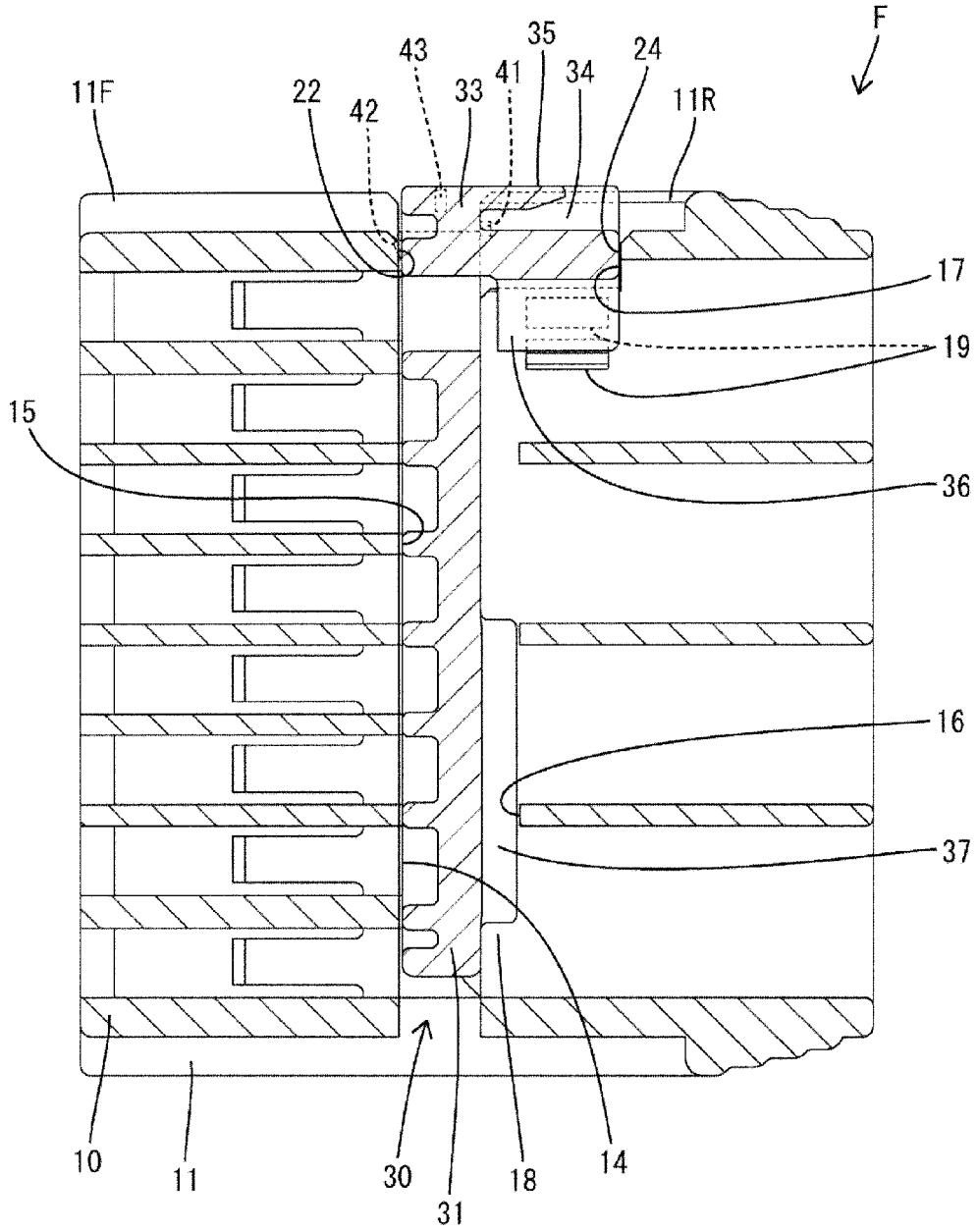
FIG. 5 is a section along C-C of FIG. 4.

As shown in FIGS. 3 and 5, the mounting hole 14 has first, second and third chambers 15-17. The first chamber 15 has upper and lower ends that communicate with the terminal housing chambers 12. The second chamber 16 has a smaller height than the first chamber 15 and the third chamber 17 has substantially the same height as the second chamber 16. The first chamber 15 is long and narrow in a lateral direction from the right surface to the left surface of the housing 10 and has a vertically long rectangular cross-sectional shape at the openings on the opposite left and right surfaces of the housing 10. A main body 31 and retaining portions 32 of the retainer 30 are housed in the first chamber 15.

Figure 11:
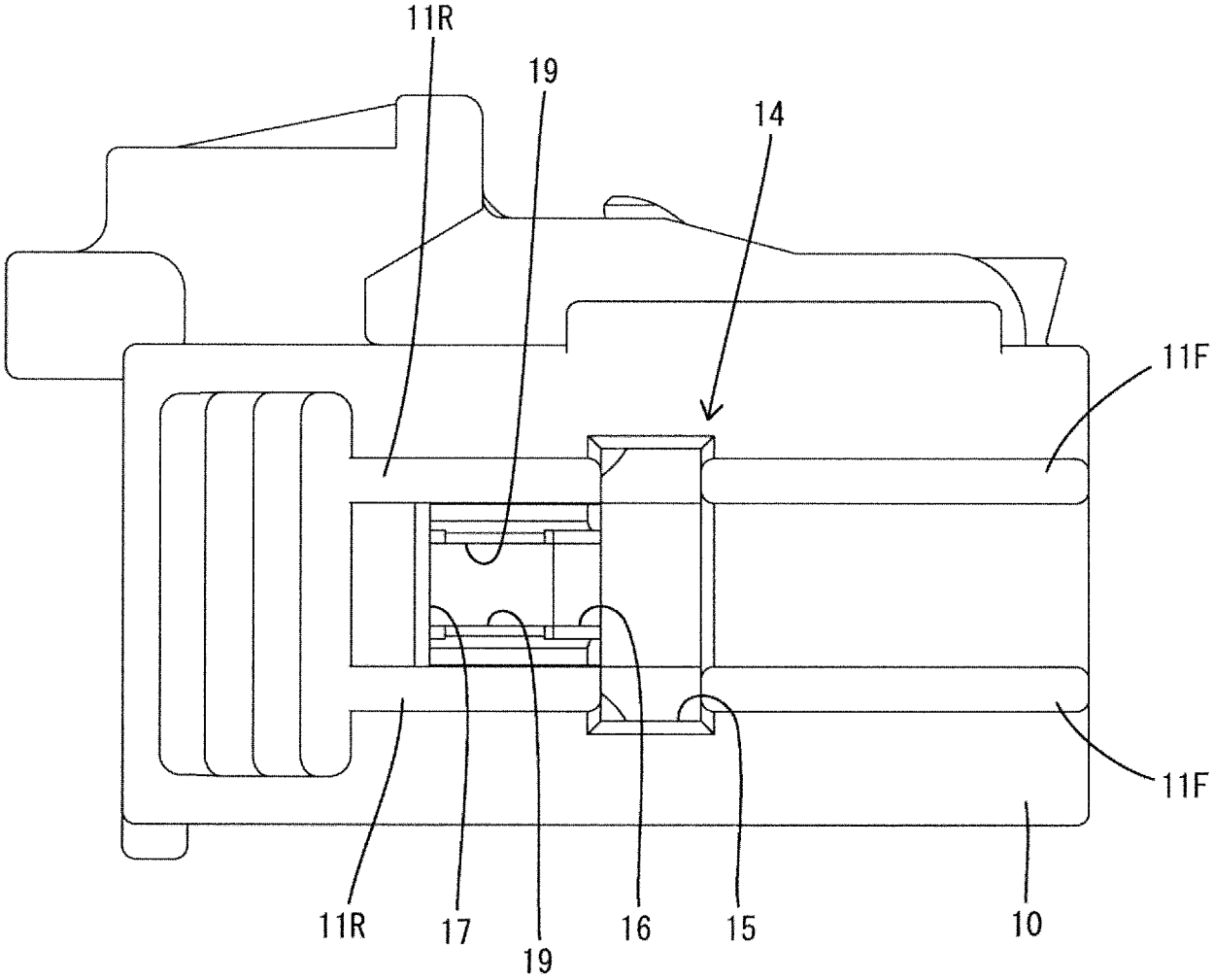
FIG. 11 is a right side view of the housing.

As shown in FIG. 11, the upper end of the first chamber 15 is at a position higher than the upper guide ribs 11 and the lower end thereof is at a position lower than the lower guide ribs 11. As shown in FIG. 10, the first chamber 15 on the right surface of the housing 10 divides each of the upper and lower ribs 11 into a front rib 11F and a rear rib 11R. The rear surface of the front rib 11F is flush and continuous with the front surface of the first chamber 15. The front surface of the rear rib 11R is flush and continuous with the rear surface of the first chamber 15.

As shown in FIGS. 10 and 11, the second chamber 16 communicates with the rear surface of the first chamber 15 and is long and narrow in the lateral direction. The right end of the second chamber 16 is open on the right surface of the housing 10, and the left end thereof is closed by an outer wall of the housing 10. The second chamber 16 has a vertically long rectangular cross-sectional shape that opens on the right surface of the housing 10. Centers of the first and second chambers 15 and 16 are at the same height positions. The upper surface of the second chamber 16 is formed by bottom walls of the terminal housing chambers 12 in the upper row and the lower surface of the second chamber 16 is formed by upper walls of the terminal housing chambers 12 in the lower row.

Most areas of the upper and lower surfaces of this second chamber 16 excluding a right end part function as upper and lower guides 18. The guides 18 extend straight in the lateral direction (i.e. parallel to the mounting direction of the retainer 30 into the housing 10). As shown in FIGS. 2 and 5, slide-contacts 37 of the retainer 30 are housed into the second chamber 16 while sliding in contact with the guides 18.

As shown in FIG. 10, a formation area of the third chamber 17 in the lateral direction is limited to only a right end part of the housing 10. The third chamber 17 communicates with the rear surface of the second chamber 16. A right end part of the third chamber 17 is open on the right surface of the housing 10. An operating portion 34 and resilient lock pieces 36 of the retainer 30 are housed in the third chamber 17. A Two laterally spaced locking projections 19 are formed on an area of each of the upper and lower surfaces of the third chamber 17 excluding the right end part.

Figure 12:
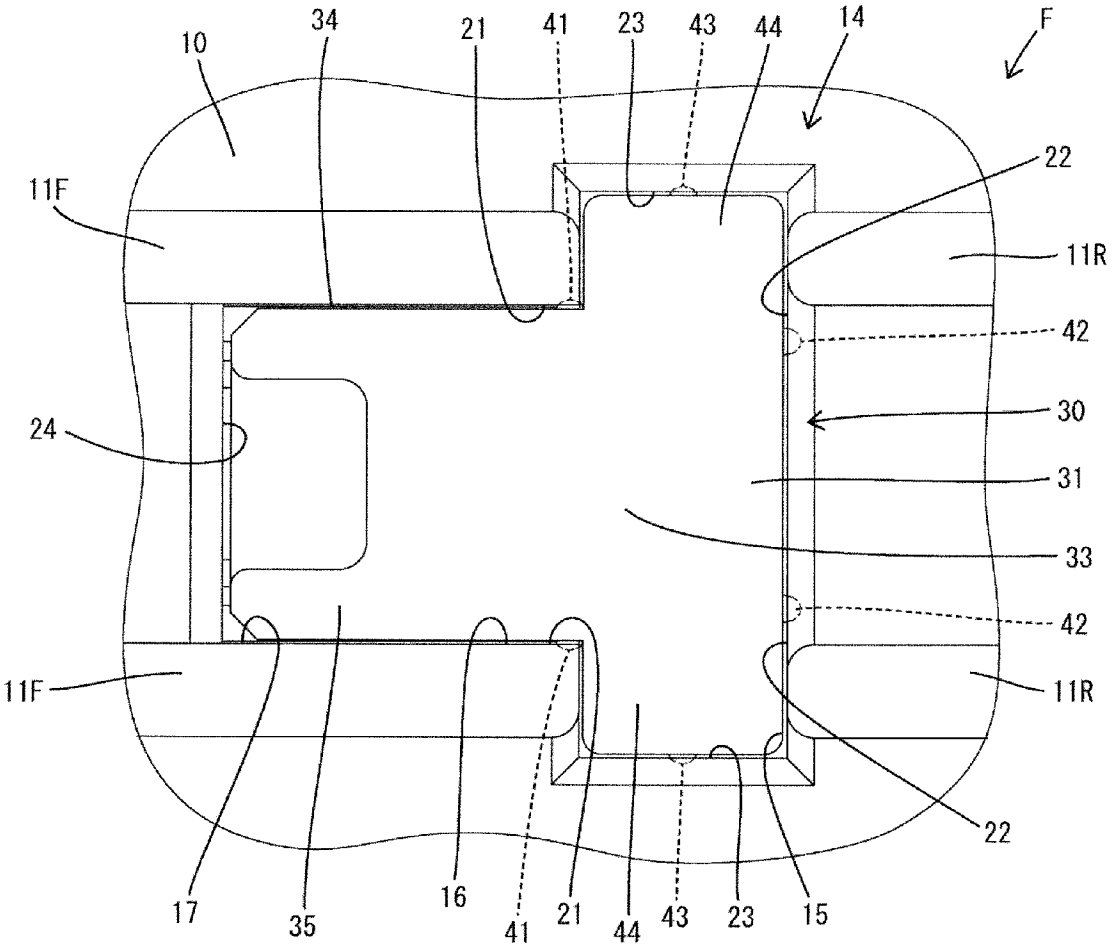
FIG. 12 is a partial enlarged right side view showing a state where the retainer is mounted in the housing.

As shown in FIGS. 10, 11 and 12, inner surfaces of the right end part of the mounting hole 14 include first backlash eliminating surfaces 21 for eliminating backlash of the retainer 30 at both the partial locking position and the full locking position, second backlash eliminating surfaces 22 for eliminating backlash of the retainer 30 at the partial locking position and third backlash eliminating surfaces 23 for eliminating backlash of the retainer 30 at the full locking position.

Upper surfaces of the right end parts of the second and third chambers 16 and 17 are flush and continuous with the lower surface of the upper rear rib 11R, and lower surfaces of the right end parts of the second and third chambers 16 and 17 are flush and continuous with the upper surface of the lower rear rib 11R. An area from the upper surface of the right end part of the second chamber 16 to the lower surface of the upper rear rib 11R and an area from the lower surface of the right end part of the second chamber 16 to the upper surface of the lower rear rib 11R define first backlash eliminating surfaces 21 that vertically face each other.

The right ends of upper and lower parts of the front surface of the first chamber 15 are flush and continuous with the rear end surfaces of the upper and lower front ribs 11 F. The right ends of the upper and lower parts of the front surface of the first chamber 15 define upper and lower second backlash eliminating surfaces 22 that face backward. Further, the upper and lower surfaces of the right end part of the first chamber 15 define vertically facing third backlash eliminating surfaces 23. Additionally, the rear surface of the right end of the third chamber 17 defines a fourth backlash eliminating surface 24 facing the second backlash eliminating surfaces 22 in the front-back direction.

Figure 6:
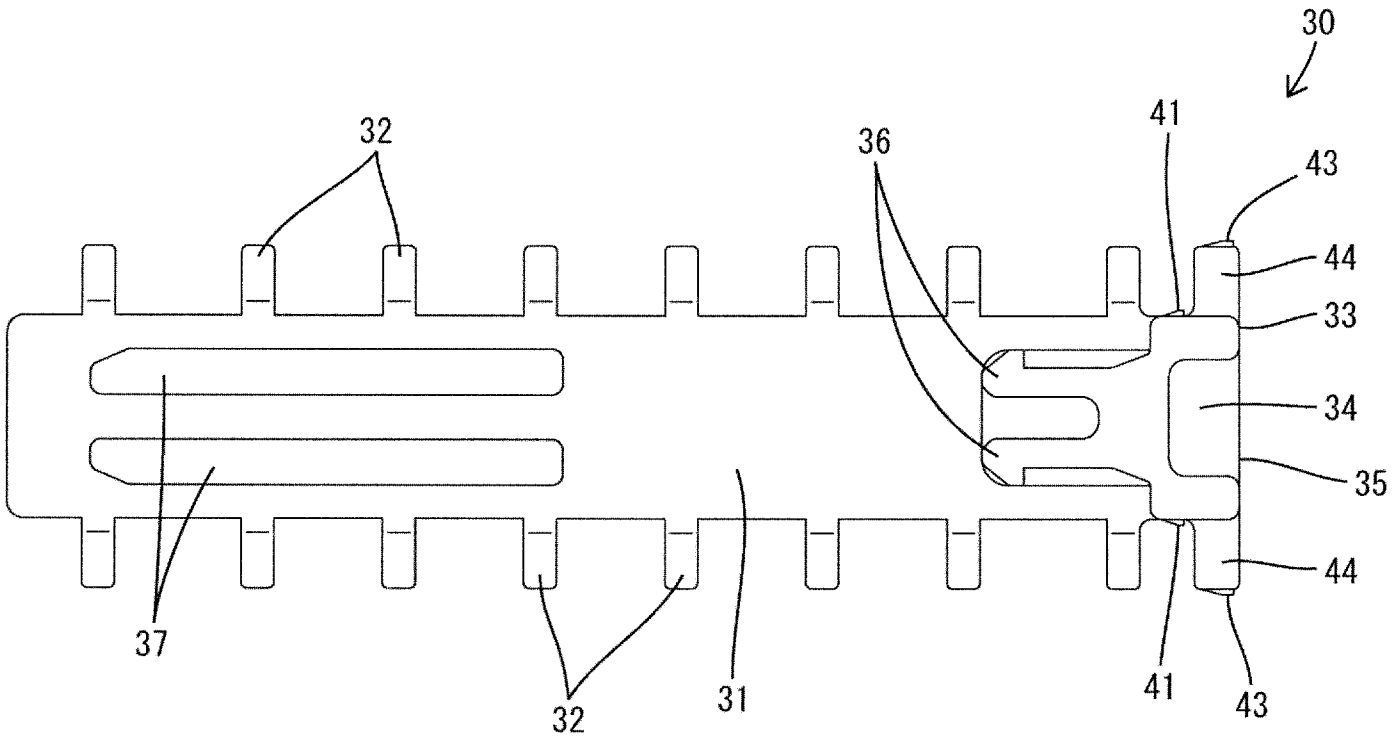
FIG. 6 is a rear view of the retainer.
Figure 7:
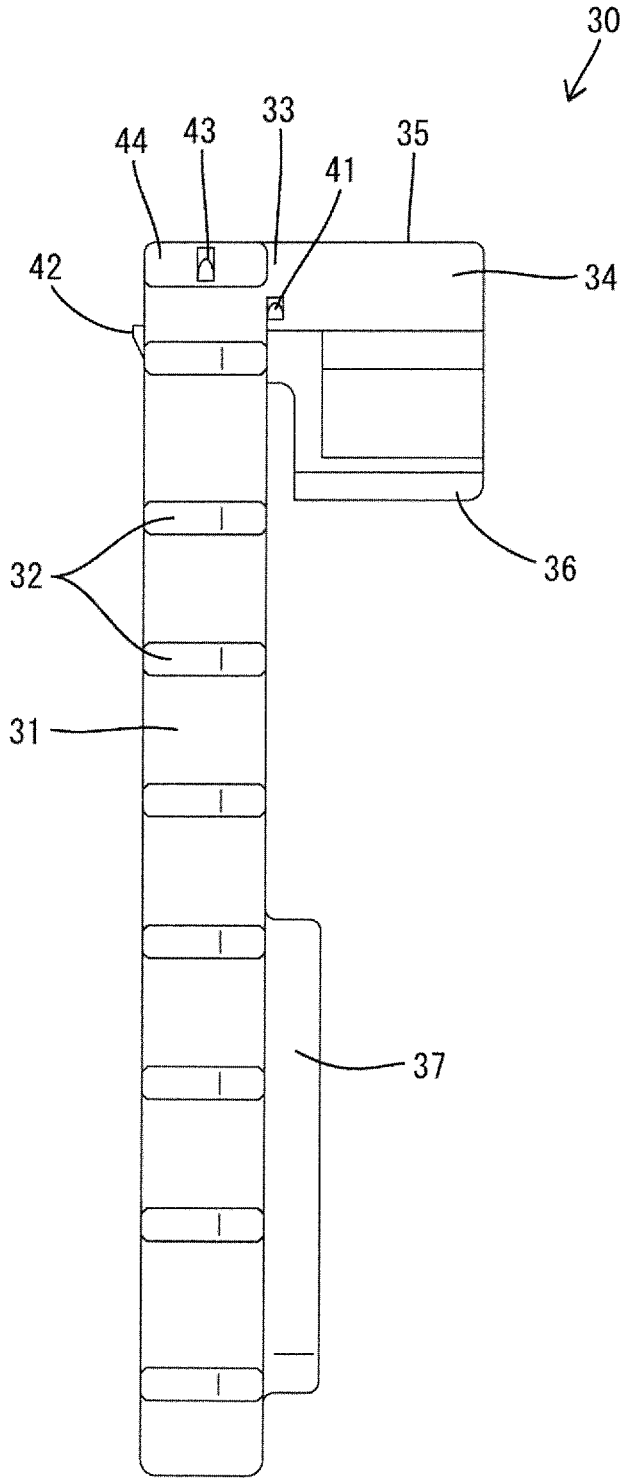
FIG. 7 is a plan view of the retainer.
Figure 8:
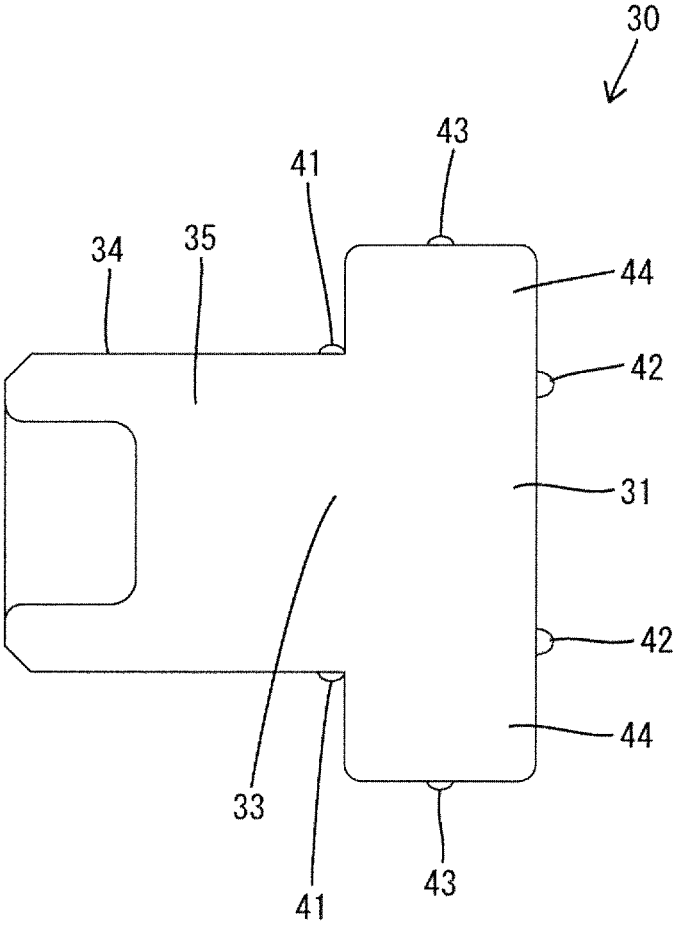
FIG. 8 is a right side view of the retainer.

As shown in FIGS. 6 to 8, the main body 31 of the retainer 30 is long and narrow in the lateral direction parallel to the mounting direction of the retainer 30 into the housing 10. Retaining portions 32 project up from the upper surface of the main body 31 and are spaced laterally to correspond to the terminal housing chambers 12. Retaining portions 32 also project down from the lower surface of the main body 31 and are spaced laterally apart to correspond to the terminal housing chambers 12.

A base 33 at the rear of the retainer 30 in the mounting direction into the housing 10 is configured to be gripped by an operator when mounting the retainer 30. The operating portion 34 is formed on the base 33 and is cantilevered back from a right end of the main body 31 in a direction intersecting the mounting direction of the retainer 30 at a substantially right angle. The operating portion 34 is a rectangular plate and the right surface of the operating portion 34 defines a flat operating surface 35 to be pushed by the operator when mounting the retainer 30 into the housing 10. Two vertically spaced resilient lock pieces 36 are arranged on the base 33 of the retainer 30 and define locks for holding the retainer 30 in a mounted state in the housing 10. The resilient lock pieces 36 are cantilevered left from the left surface of the operating portion 34.

Upper and lower slide-contacts 37 are formed in an area of the tip side of the retainer 30 in the mounting direction. The slide-contacts 37 define ribs projecting back from the rear surface of the main body 31 and extend straight in the lateral direction (i.e. parallel to the mounting direction of the retainer 30). The slide-contact portions 37 extend from a position near the left end of the main body 31 of the retainer 30 to a substantially lengthwise center position of the main body 31. An extending direction of the slide-contact portions 37 from the main body 31 is the same direction as that of the operating portion 34 from the main body 31.

First, second and third backlash eliminating projections 41, 42 and 43 are formed on the base 33 of the retainer 30. More particularly, two first backlash eliminating projections 41 are formed respectively on upper and lower surfaces of a front end part of the operating portion 34 closest to the main body 31, and hence project in opposite vertical directions. Two second backlash eliminating projections 42 are formed on a right end part of the front surface of the main body 31 and project forward. Two plate-like projections 44 project up and down respectively on the right end of the main body 31 and two third backlash eliminating projections 43 are formed respectively on the upper and lower surfaces of the upper and lower plate-like projections 44. Hence the third backlash eliminating projections 43 project in opposite vertical directions.

The retainer 30 is mounted at the partial locking position with respect to the housing 10 before mounting the terminal fittings 50 into the housing 10. More particularly, the retainer 30 is inserted into the mounting hole 14 from the right side of the housing 10 with a left end of the main body 31 in the lead. At this time, the main body 31 and the retaining portions 32 are fit into the first chamber 15 and the upper and lower slide-contact portions 37 are fit into the second chamber 16.

The retainer 30 is mounted further by pushing the operating surface 35. In the process of mounting the retainer 30, the upper slide-contact 37 slides in contact with the upper guide 18 and the lower slide-contact 37 slides in contact with the lower guide 18, thereby restricting relative vertical displacement of the retainer 30 with respect to the housing 10. Thus, the retainer 30 moves with a correct posture.

Figure 4:
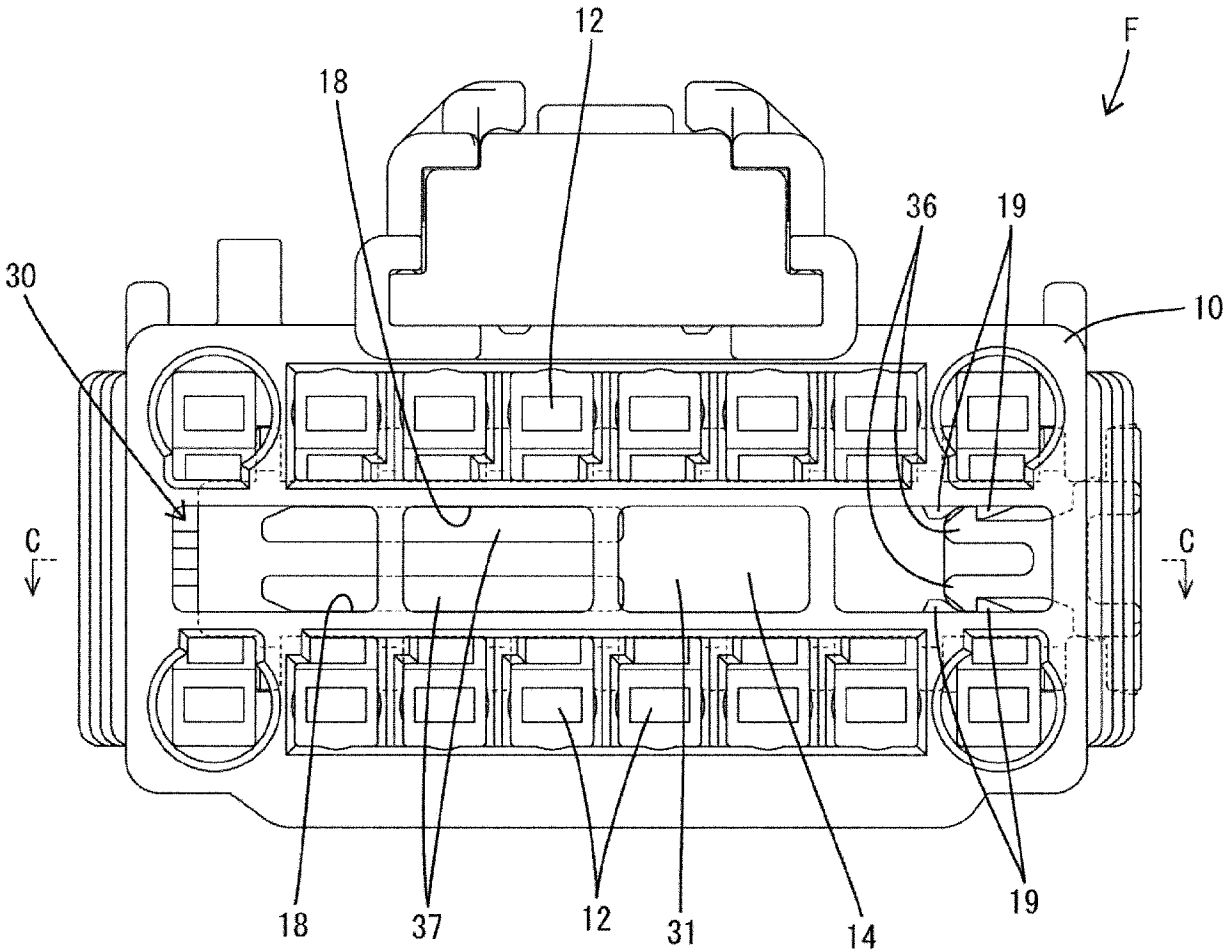
FIG. 4 is a rear view of the connector showing a state where the retainer is mounted at a partial locking position.

As the retainer 30 is moved further, the operating portion 34 and the resilient lock pieces 36 enter the third chamber 17. The upper and lower resilient lock pieces 36 interfere with the locking projections 19 and deflect resiliently toward each other as the retainer 30 approaches the partial locking position. The resilient lock pieces 36 resiliently restore and fit into gaps between the adjacent locking projections 19 when the retainer 30 reaches the partial locking position, as shown in FIG. 4. This locking action holds the retainer 30 at the partial locking position with relative lateral displacement restricted. As shown in FIG. 5, the base end 33 of the retainer 30 is located outside the mounting hole 14 when the retainer 30 is at the partial locking position.

The retaining portions 32 are retracted rightward from the terminal fittings 50 when the retainer 30 is at the partial locking position. Thus, the terminal fitting 50 can be inserted into each terminal housing chamber 12. Further, the main body 31 is between the upper and lower terminal housing chambers 12. There is a concern that a vertical shaking of the retainer 30 may cause a part of the main body 31 to enter the terminal housing chambers 12 and interfere with the terminal fittings 50 being inserted.

Accordingly, a contact structure is provided for pressing the upper and lower first backlash eliminating projections 41 on the retainer 30 into contact with the first backlash eliminating surfaces 21 in the housing 10 to vertically press the first backlash eliminating surfaces 21 on the base 33 of the retainer 30, as shown in FIGS. 10 and 12, for preventing backlash of the retainer 30 in the vertical direction when the retainer 30 is at the partial locking position. Additionally, a fitting structure is provided for fitting the slide-contacts 37 of the retainer 30 between the upper and lower guides 18, as shown in FIG. 3. These contact and fitting structures restrict vertical backlash and vertical inclination of the retainer 30 at the partial locking position. Thus, the insertion of the terminal fittings 50 is not affected by vertical backlash of the retainer 30.

With the retainer 30 at the partial locking position, the second backlash eliminating projections 42 on the front surface of the retainer 30 are pressed into contact with the second backlash eliminating surfaces 22 of the housing 10 from behind and the rear end surface of the operating portion 34 on the base 33 of the retainer 30 is pressed into contact with the fourth backlash eliminating surface 24 of the housing 10 from the front of the retainer 30, as shown in FIG. 5. Further, on the tip side (left end) of the retainer 30 in the mounting direction, the front and rear surfaces of the main body 31 are in contact with the front and rear surfaces of the first chamber 15. These contacts restrict relative displacement of the retainer 30 in the front-back direction with respect to the housing 10. Note that the third backlash eliminating projections 43 are located outside the mounting hole 14 and at non-corresponding positions retracted rightward from the third backlash eliminating surfaces 23.

A pushing force exceeding a locking force of the locking projections 19 and the lock projections is applied to the operating surface 35 after the terminal fittings 50 are inserted into all of the terminal housing chambers 12. The resilient lock pieces 36 then deform resiliently and the retainer 30 moves from the partial locking position to the full locking position. The resilient lock pieces 36 are locked to the left locking projections 19 from the left side when the retainer 30 reaches the full locking position for holding the retainer 30 at the full locking position, as shown in FIG. 1. The retaining portions 32 engage the rectangular tubes 51 of the terminal fittings 50 from behind with the retainer 30 is at the full locking position to retain the terminal fittings 50. Thus, the terminal fittings 50 are held in a reliably retained state by primary locking action of the locking lances 13 and secondary locking action of the retainer 30. Further, the sliding contact of the slide-contacts 37 with the guides 18 when the retainer 30 moves from the partial locking position to the full locking position restricts a vertical inclination of the retainer 30.

The upper and lower first backlash eliminating projections 41 are pressed into contact with the first backlash eliminating surfaces 21 on the base 33 of the retainer 30 to press the first backlash eliminating surfaces 21 vertically when the retainer 30 is at the full locking position, as when the retainer 30 is at the partial locking position. Thus, the backlash of the base 33 of the retainer 30 in the vertical direction is restricted. Likewise, the upper and lower third backlash eliminating projections 43 formed on the base 33 of the retainer 30 are pressed into contact with the third backlash eliminating surfaces 23 formed in the housing 10 to press the third backlash eliminating surfaces 23 vertically. These contact actions in the pressed state restrict the vertical backlash of the base end 33 of the retainer 30. Vertical backlash of the tip of the retainer 30 in the mounting direction also is restricted by the contact of the slide-contacts 37 and the guides 18. Note that the second backlash eliminating projections 42 are deviated from the second backlash eliminating surfaces 22.

The female connector F has the retainer 30 that is selectively mounted at the partial locking position for allowing the inserting operation of the terminal fittings 50 and the full locking position for locking the already terminal fittings 50 to retain the terminal fittings 50. The rear end part of the retainer 40 in the mounting direction into the housing 10 defines the base 33 that is located outside the mounting hole 14 when the retainer 30 is at the partial locking position. The housing 10 is formed with the first and second backlash eliminating surfaces 21 and 22, and the base 33 of the retainer 30 is formed with first and second backlash eliminating projections 41 and 42 for restricting a relative displacement of the retainer 30 with respect to the housing 10 by coming into contact with each other when the retainer 30 is at the partial locking position. This contact of the first and second backlash eliminating projections 41 and 42 with the first and second backlash eliminating surfaces 21, 22 restricts restrict relative displacement between the retainer 30 and the housing 10 when the retainer 30 is at the partial locking position and can prevent the inserting operation of the terminal fittings 50 from being affected by relative displacement of the retainer 30.

The guide ribs 11 are formed on the outer surfaces of the housing 10 and the first backlash eliminating surfaces 21 of the housing 10 are formed on the guide ribs 11. Thus, the guide ribs 11 also function as the first backlash eliminating surfaces 21, and the shape of the housing 10 can be simplified as compared with the case where the guide ribs 11 do not function to eliminate backlash.

The invention is not limited to the above described embodiment. For example, the following embodiments also are included in the scope of the invention.

The guide ribs function as backlash eliminating portions in the above embodiment, but they may not function as backlash eliminating portions.

The slide-contacts are formed on the tip side of the retainer in the mounting direction and slide in contact with the guides of the housing. However, such a slide contact structure of the slide-contacts and the guides may be not provided.

List of Reference Signs

F . . . female connector (connector)
M . . . mating connector
10 . . . housing
11 . . . guide rib
14 . . . mounting hole
18 . . . guide portion
21 . . . first backlash eliminating surface of housing
22 . . . second backlash eliminating surface of housing
30 . . . retainer
33 . . . base of retainer
37 . . . slide-contact
41 . . . first backlash eliminating projection of retainer
42 . . . second backlash eliminating projection of retainer
50 . . . terminal fitting

What is claimed is:

1. A connector, comprising:

a housing with a mounting hole open into the housing and a guide rib formed on an outer surface of the housing for stabilizing a connecting posture when the connector is being fit to a mating connector;

a terminal fitting to be inserted into the housing;

a retainer mounted into the mounting hole and selectively movable between a partial locking position for allowing an inserting operation of the terminal fitting and a full locking position for locking the already inserted terminal fitting;

a base defined at a rear end of the retainer in a mounting direction into the housing and located outside the mounting hole when the retainer is at the partial locking position; and backlash eliminating portions formed on the base and in the housing and configured to restrict a relative displacement of the retainer with respect to the housing by contact each other when the retainer is at the partial locking position, the backlash eliminating portion of the housing being formed on the guide rib.

2. A connector, comprising:

a housing with a mounting hole open into the housing;

a terminal fitting to be inserted into the housing;

a retainer mounted into the mounting hole and selectively movable between a partial locking position for allowing an inserting operation of the terminal fitting and a full locking position for locking the already inserted terminal fitting;

a base defined at a rear end of the retainer in a mounting direction into the housing and located outside the mounting hole when the retainer is at the partial locking position;

backlash eliminating portions formed on the base and in the housing and configured to restrict a relative displacement of the retainer with respect to the housing by contact each other when the retainer is at the partial locking position;

a slide-contact formed on a tip side of the retainer in the mounting direction and being substantially parallel to a mounting direction of the retainer; and a guide formed in the housing and extending parallel to the mounting direction of the retainer and contacting the slide-contact when the retainer is at the partial locking position.

* * * * *